US010283244B2

(12) United States Patent
Chu

(10) Patent No.: US 10,283,244 B2
(45) Date of Patent: May 7, 2019

(54) DOWNHOLE SOLENOID ACTUATOR DRIVE SYSTEM

(71) Applicant: Halliburton Energy Services, Inc., Houston, TX (US)

(72) Inventor: Jianying Chu, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 343 days.

(21) Appl. No.: 15/116,008

(22) PCT Filed: Dec. 29, 2014

(86) PCT No.: PCT/US2014/072577

§ 371 (c)(1),
(2) Date: Aug. 2, 2016

(87) PCT Pub. No.: WO2016/108825

PCT Pub. Date: Jul. 7, 2016

(65) Prior Publication Data

US 2017/0186523 A1 Jun. 29, 2017

(51) Int. Cl.

| | |
|---|---|
| ***H01H 47/00*** | (2006.01) |
| ***H01F 7/06*** | (2006.01) |
| ***E21B 47/18*** | (2012.01) |
| ***H01F 7/16*** | (2006.01) |

(52) U.S. Cl.

CPC ..... *H01F 7/064* (2013.01); *E21B 47/18* (2013.01); *E21B 47/185* (2013.01); *H01F 7/1607* (2013.01)

(58) Field of Classification Search

CPC ..... H01F 7/064

See application file for complete search history.

(56) References Cited

U.S. PATENT DOCUMENTS

| | | | |
|---|---|---|---|
| 4,531,579 | A | 7/1985 | Larronde et al. |
| 4,636,934 | A | 1/1987 | Schwendemann et al. |
| 6,175,484 | B1 | 1/2001 | Caruthers et al. |

(Continued)

FOREIGN PATENT DOCUMENTS

| | | | |
|---|---|---|---|
| EA | 200801249 | A1 | 10/2008 |
| RU | 2305215 | C2 | 8/2007 |

(Continued)

OTHER PUBLICATIONS

International Search Report and Written Opinion issued in related PCT Application No. PCT/US2014/072577 dated Aug. 31, 2015, 16 pages.

(Continued)

*Primary Examiner* — Stephen W Jackson

(74) *Attorney, Agent, or Firm* — Jason Sedano; Baker Botts L.L.P.

(57) ABSTRACT

An example method for driving a solenoid actuator includes providing at least one solenoid of the solenoid actuator coupled to a power supply through a plurality of switches. The at least one solenoid of the solenoid actuator may be energized by closing at least one switch of the plurality of switches. Energy from the at least one solenoid may be discharged to the power supply or another solenoid of the solenoid actuator by at least one of opening the at least one switch of the plurality of switches and closing at least one other switch of the plurality of switches.

20 Claims, 6 Drawing Sheets

(56) References Cited

U.S. PATENT DOCUMENTS

| | | | | |
|---|---|---|---|---|
| 7,612,978 | B2 | 11/2009 | Bergstrom et al. | |
| 7,911,758 | B2 * | 3/2011 | Haller | H02M 3/155 361/189 |
| 2007/0188967 | A1 * | 8/2007 | Smith | H01F 7/1816 361/155 |
| 2013/0080063 | A1 | 3/2013 | Pillai et al. | |
| 2013/0248002 | A1 | 9/2013 | Haller et al. | |

FOREIGN PATENT DOCUMENTS

| | | | |
|---|---|---|---|
| RU | 2328588 | C2 | 10/2008 |
| WO | 2009/138849 | A1 | 11/2009 |

OTHER PUBLICATIONS

International Preliminary Report on Patentability issued in related Application No. PCT/US2014/072577, dated Jul. 13, 2017 (13 pages).
Search report issued in related Russian application No. 2017113104, dated Mar. 29, 2018, 4 pages.
Examiner's Letter issued in related Canadian application No. 2,966,784, dated Oct. 2, 2018, 3 pages.

* cited by examiner

DOWNHOLE SOLENOID ACTUATOR DRIVE SYSTEM

CROSS-REFERENCE TO RELATED APPLICATION

The present application is a U.S. National Stage Application of International Application No. PCT/US2014/072577 filed Dec. 29, 2014, which is incorporated herein by reference in its entirety for all purposes.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation. In certain instances, communications may take place between the surface of the well site and downhole elements. These communications may be referred to as downhole telemetry and may be used to transmit data from downhole sensors and equipment to computing systems located at the surface, which may utilize the data to inform further operations in numerous ways.

One type of downhole telemetry utilizes pressure waves in drilling fluid circulated through the wellbore during a drilling operation. These pressure waves typically are generated by one or more solenoid actuators that transform electrical energy into mechanical force, altering the flow of drilling fluid and thereby creating pressure waves that can be received at the surface. In some cases, hundreds of watts of power may be used to generate the necessary mechanical force. This amount of power can cause excess heat generation within the solenoid actuator.

FIGURES

Some specific exemplary embodiments of the disclosure may be understood by referring, in part, to the following description and the accompanying drawings.

Figure 1:
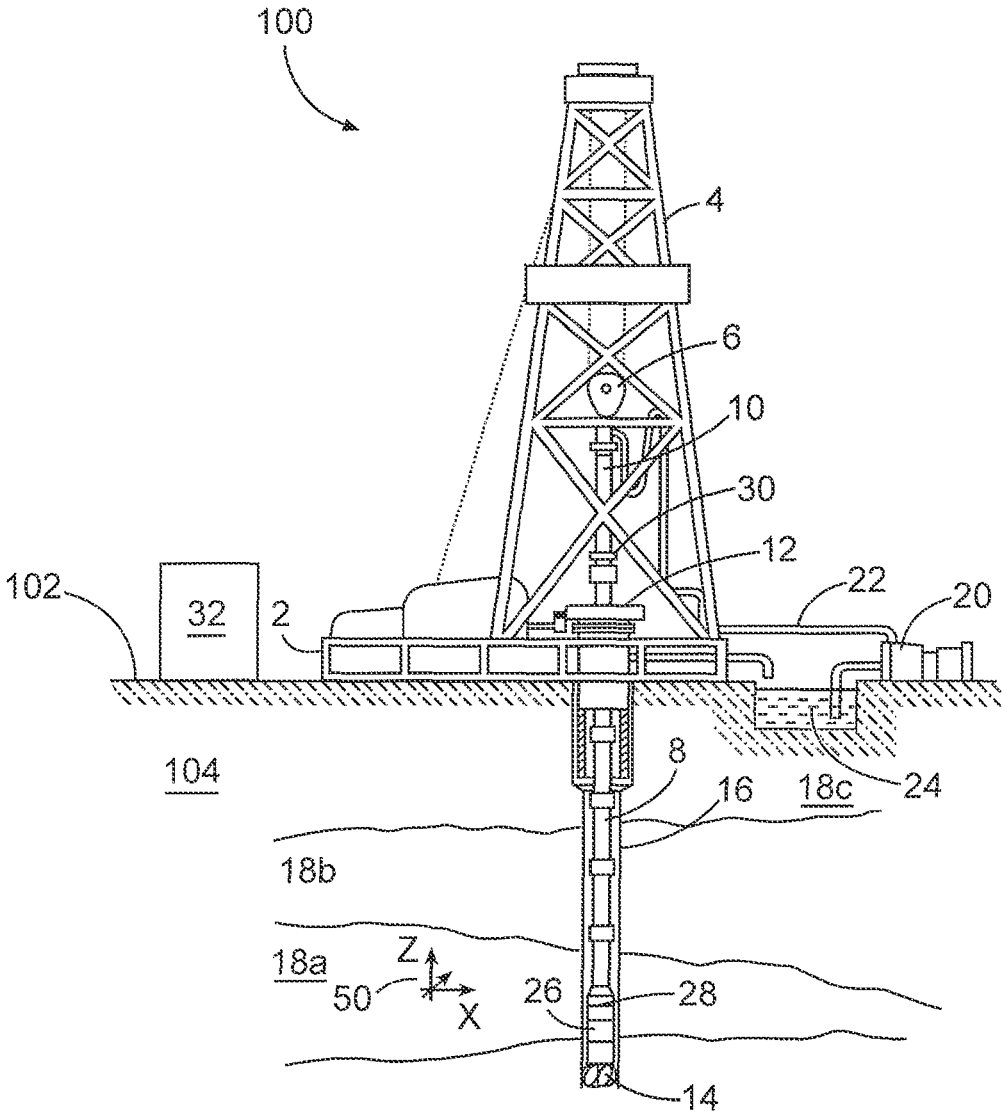
FIG. 1 is a diagram showing an example subterranean drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like. "Measurement-while-drilling" ("MWD") is the term generally used for measuring conditions downhole concerning the movement and location of the drilling assembly while the drilling continues. "Logging-while-drilling" ("LWD") is the term generally used for similar techniques that concentrate more on formation parameter measurement. Devices and methods in accordance with certain embodiments may be used in one or more of wireline (including wireline, slickline, and coiled tubing), downhole robot, MWD, and LWD operations.

The terms "couple," "coupled," and "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

The present disclosure relates generally to downhole drilling operations and, more particularly, to a downhole solenoid actuator drive system. As will be described in detail below, example downhole solenoid actuator drive systems described herein may allow for excess or stored power with the solenoid actuator to be recaptured at a power supply. This may reduce the excess heat generation at the solenoid actuator which may increase the response time of the solenoid actuator and/or allow for the omission of a heat sink from the telemetry system.

FIG. 1 is a diagram of an illustrative subterranean drilling system 100 including a solenoid actuator drive system, according to aspects of the present disclosure. The drilling system 100 comprises a drilling platform 2 positioned at the surface 102. In the embodiment shown, the surface 102 comprises the top of a formation 104 containing one or more rock strata or layers 18*a-c*, and the drilling platform 2 may be in contact with the surface 102. In other embodiments, such as in an off-shore drilling operation, the surface 102 may be separated from the drilling platform 2 by a volume of water.

The drilling system 100 comprises a derrick 4 supported by the drilling platform 2 and having a traveling block 6 for raising and lowering a drill string 8. A kelly 10 may support the drill string 8 as it is lowered through a rotary table 12. A drill bit 14 may be coupled to the drill string 8 and driven by a downhole motor and/or rotation of the drill string 8 by the rotary table 12. As bit 14 rotates, it creates a borehole 16 that passes through one or more rock strata or layers 18*a-c*. A pump 20 may circulate drilling fluid through a feed pipe 22 to kelly 10, downhole through the interior of drill string 8, through orifices in drill bit 14, back to the surface via the annulus around drill string 8, and into a retention pit 24. The drilling fluid transports cuttings from the borehole 16 into the pit 24 and aids in maintaining integrity of the borehole 16.

The drilling system 100 may comprise a bottom hole assembly (BHA) 150 coupled to the drill string 8 near the drill bit 14. The BHA may comprise various downhole measurement tools and sensors, including LWD/MWD elements 26. Example LWD/MWD elements 26 include antenna, sensors, magnetometers, gradiometers, etc. As the bit extends the borehole 16 through the formations 18, the LWD/MWD elements 26 may collect measurements relating to the formation and the drilling assembly.

In certain embodiments, the measurements taken by the LWD/MWD elements 26 and data from other downhole tools and elements may be transmitted to the surface 102 by a telemetry system 28. In the embodiment shown, the telemetry system 28 is located within the BHA and communicably coupled to the LWD/MWD elements 26. The telemetry system 28 may transmit the data and measurements from the downhole elements as pressure pulses or waves in fluids injected into or circulated through the drilling assembly, such as drilling fluids, fracturing fluids, etc. The pressure pulses may be generated in a particular pattern, waveform, or other representation of data, an example of which may include a binary representation of data that is received and decoded at a surface receiver 30. The positive or negative pressure pulses may be received at the surface receiver 30 directly, or may be received and re-transmitted via signal repeaters 50. Such signal repeaters may, for example, be coupled to the drill string 8 at intervals, contain fluidic pulsers and receiver circuitry to receive and re-transmit corresponding pressure signals, and aide in the transmission of high frequency signals from the telemetry system 28, which would otherwise attenuate before reaching the surface receiver 30. The drilling system 100 may further comprise an information handling system 32 positioned at the surface 102 that is communicably coupled to the surface receiver 30 to receive telemetry data from the LWD/MWD elements 26 and process the telemetry data to determine certain characteristics of the formation 104.

Figure 2:
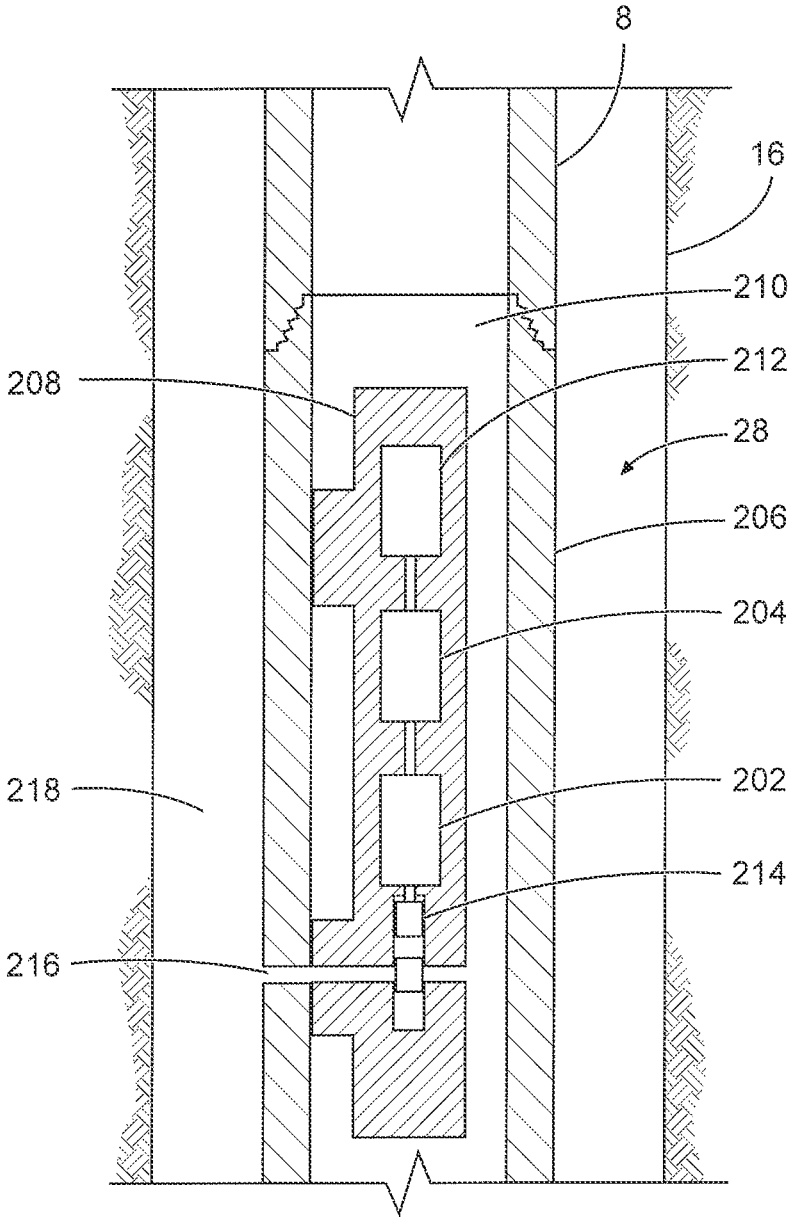
FIG. 2 is a diagram showing an example telemetry system, according to aspects of the present disclosure.

FIG. 2 is a diagram illustrating an example embodiment of the telemetry system 28, according to aspects of the present disclosure. The telemetry system 28 may comprise a solenoid actuator 202 and a solenoid actuator drive system 204 electrically coupled to the solenoid actuator 202. The solenoid actuator 202 and solenoid actuator drive system 204 may be coupled to a drill collar 206, which may be coupled to a drill string 8 when the telemetry system 28 is deployed within the borehole 16. In the embodiment shown, the solenoid actuator 202 and the drive system 204 are located within an housing 208 coupled to an interior surface of the drill collar 206 and positioned within an inner bore 210 of the drill collar 206. The housing 208 may allow drilling fluid flow through the inner bore 210 via one or more channels or annular areas between the housing 208 and the drill collar 206. In other embodiments, one of the solenoid actuator 202 and the downhole solenoid actuator drive system 204 may be located in the outer tubular structure of the drill collar 206 to provide greater fluid flow through the bore 210. Additionally, although one drill collar 206 is shown, multiple drill collars may be used.

The telemetry system 28 may further comprise a power supply 212 coupled to the drive system 204. The power supply 212 may comprise a bank of capacitors that are capable of storing and quickly providing the large amounts of power necessary to trigger the solenoid actuator 202. In certain embodiments, the power supply 212 may also be coupled to a power source (not shown) that provides the power stored in the capacitor bank. Example power sources include battery packs or fluid-driven electric generators. In the embodiment shown, the power supply 212 is located in the housing 208 with the drive system 204, although other locations are possible, including outside of the drill collar 206. Additionally, the power supply 212 may be incorporated into drive system 204.

The drive system 204 may selectively couple one or more solenoids of the solenoid actuator 202 to the power supply 212 to cause the actuator to move between first and second positions, which may correspond to positions of an element coupled to the solenoid actuator 202. In the embodiment shown, the solenoid actuator 202 is coupled to a gate valve 214 that is movable between fixed positions within a chamber 216 in the housing 208. These fixed positions may comprise an "open" position in which the gate valve 214 completes a fluid conduit 216 between the inner bore 210 and an annulus 218 between the drill collar 206 and the borehole 16; and a "close" position when the gate valve 214 blocks the fluid conduit 216. When the gate valve 214 moves to the "open" position from the "close" position, drilling fluid flowing within the inner bore 210 may exit into the annulus 208, causing a decrease in the drilling fluid volume within the inner bore 210 and a corresponding drop in pressure in the drilling fluid that may propagate upwards to the surface through the drill string 8. Conversely, when the gate valve 214 moves to the "close" position from the "open" position, it may cause an in the drilling fluid volume within the inner bore 210 and a corresponding increase in pressure in the drilling fluid. Accordingly, by toggling the gate valve 214 between "open" and "close" positions, the solenoid actuator 202 and drive system 204 may generate pressure pulses within the drilling fluid that are used to communicate downhole data to the surface.

Figure 3:
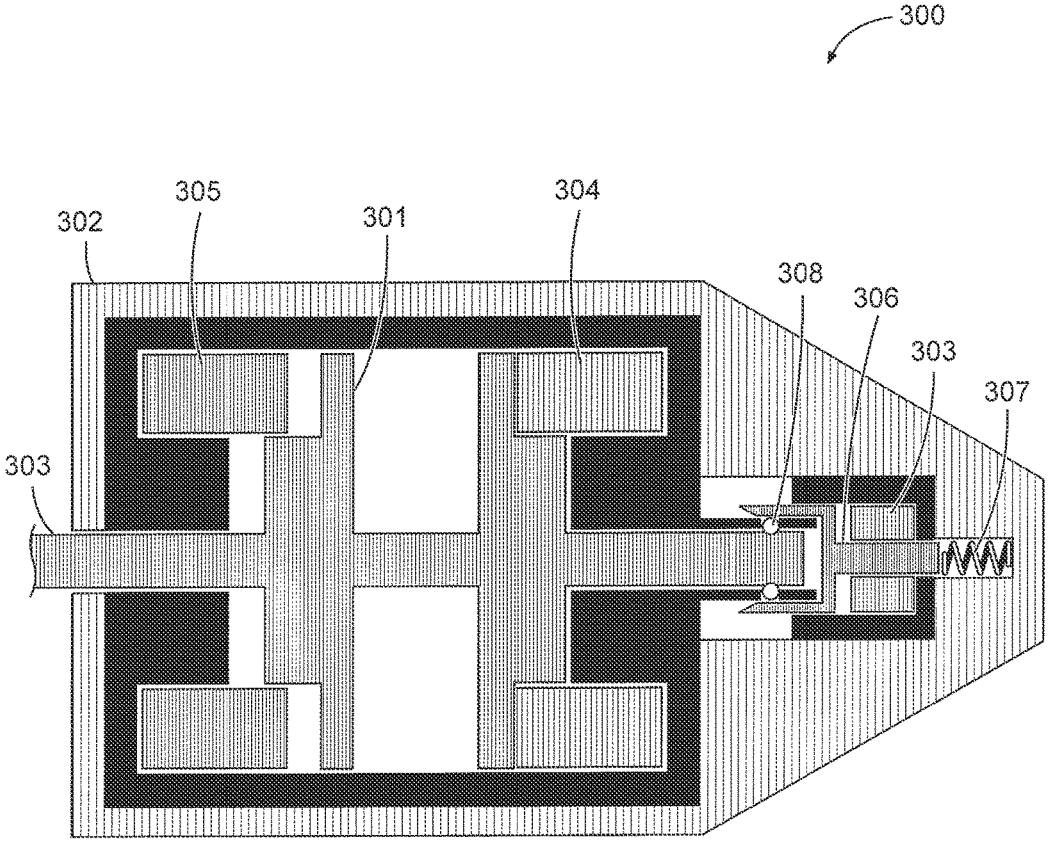
FIG. 3 is a diagram showing an example solenoid actuator, according to aspects of the present disclosure.

FIG. 3 is a diagram of an example solenoid actuator 300, according to aspects of the present disclosure. The actuator 300 may comprise a main armature 301 at least partially positioned within an outer housing 302, which may be made of a ferrous material. The actuator 300 may further comprise at least one solenoid used to move and secure the main armature 301 in first and second axial positions with respect to the outer housing 302. The armature 301 may comprise an end 303 that at least partially extends from the housing 302 to allow the armature 301 to be coupled to a movable element, such as the gate valve described above. The movable element then may be toggled between fixed axial positions with respect to the actuator 300 by causing the armature 301 to move within the housing 302.

In the embodiment shown, the actuator 300 comprises a latchable push-pull solenoid actuator with three solenoids: a first solenoid 303, a second solenoid 304, and third solenoid 305. The third solenoid 305 may be referred to as a latch solenoid and may cooperate with a latch armature 306, spring 307, and latch balls 308 to selectively mechanically secure the armature 301 in a first axial position within the housing 302. The first axial position may be characterized by the armature 301 being shifted towards the second and third solenoids 304/305. As shown in FIG. 3, when the armature 301 is in the first axial position and the first solenoid 303 is not energized, the spring 307 may urge the latch armature 306 towards the armature 301 such that the latch armature 306 forces the latch balls 308 into indentations in the armature 301 to prevent axial movement by the armature 301. When the third solenoid 305 is energized, it may overcome the spring force applied by the spring 307 to the latch armature 306, thereby moving the latch armature 306 away from the armature 301. This may cause the latch balls 308 to disengage with the armature and allow axial movement of the armature 301 within the housing 302.

The first and second solenoids 303/304 may be responsible for moving the armature 301 between first and second axial positions once the latch armature 306 and latch balls 308 are disengaged. In the embodiment shown, the first solenoid 303 may be energized to move the armature 301 from the first axial position to the second axial position, characterized by the armature 301 being shifted towards the first solenoid 303. Conversely, the second solenoid 304 may be energized to move the armature 301 from the second axial position to the first axial position. In certain embodiments, the second axial position of the armature 301 may correspond to an "open" position of a movable element coupled to the armature 301, and the first axial position of the armature may correspond to a "close" position. In those embodiments, the first solenoid 303 may be referred to as an "open" solenoid that is responsible for shifting a movable element coupled to the armature 301 to the "open" position, and the second solenoid 304 may be referred to as a "close" solenoid that is responsible for shifting a movable element coupled to the armature 301 to the "close" position. Notably, the latch solenoid 305 may mechanically secure the armature 301 in the first axial position or "close" position in the embodiment shown, but may mechanically secure the armature 301 in the "open" position in other embodiments. Likewise, the "open" and "close" function of the solenoids may change depending on the configuration of the actuator 300 and the movable element coupled to the armature 301. Additionally, the configuration of actuator 300 shown in FIG. 3 is not intended to be limiting.

Energizing the solenoids 303-305 may comprise selectively coupling the solenoids 303-305 to a power supply. Current may flow through the selected solenoid(s), generating a corresponding magnetic fields that impart force to and control the movement of the armatures. In a telemetry system, energizing the solenoids 303-305 may require hundreds of watts of power because of a high differential pressure drop and the quick actuation times needed to pulse telemetry. The differential pressure drop may comprise a few thousand pounds-per-square-inch (psi) across the movable element coupled to the solenoid actuator 300, causing very high mechanical friction that demands a high drive force at the solenoids 303-305. The quick actuation time may require high drive force in order to overcome actuator inertia within a small time interval. The drive force needed at the actuator 300 positivity correlates with the power consumption at the solenoids 303-305.

Typical solenoids are not energy efficient and only achieve about 50% energy transformation from electrical power into mechanical force. The rest of the energy is converted into heat. In practice, solenoids may need to store sufficient energy before to generating the required mechanical force, and the stored energy may be converted into heat. When coupled with the high drive force necessary for downhole telemetry, the stored energy may represent a substantial part of the total energy usage and cause excessive heat generation. This heat can damage sensitive electronic components unless a secondary heat dissipation system, such as a heat sink, is used, or the heat generation is reduced by limiting the actuation frequency of the actuator.

According to aspects of the present disclosure, a solenoid drive system may be used to recapture and/or reuse stored energy from the solenoids of a solenoid actuator rather than allowing the energy to be dissipated as heat. In certain embodiments, the stored energy may be recaptured at a power supply coupled to the solenoids, allowing the energy to be reused to energize other solenoids of the actuator. In certain embodiments, the stored energy may also be transmitted from one solenoid of an actuator to another solenoid of the actuator such that stored energy from one solenoid may be used to energize another solenoid. Recapturing and reusing the stored energy may reduce the heat generated by solenoid actuator, reduce the need for a heat sink within the drive system, reduce the total power consumption so that a smaller power supply can be used, and potentially increase the frequency of the solenoid actuator, which may increase the transmission capability of a telemetry system incorporating the solenoid drive system.

Figure 4:
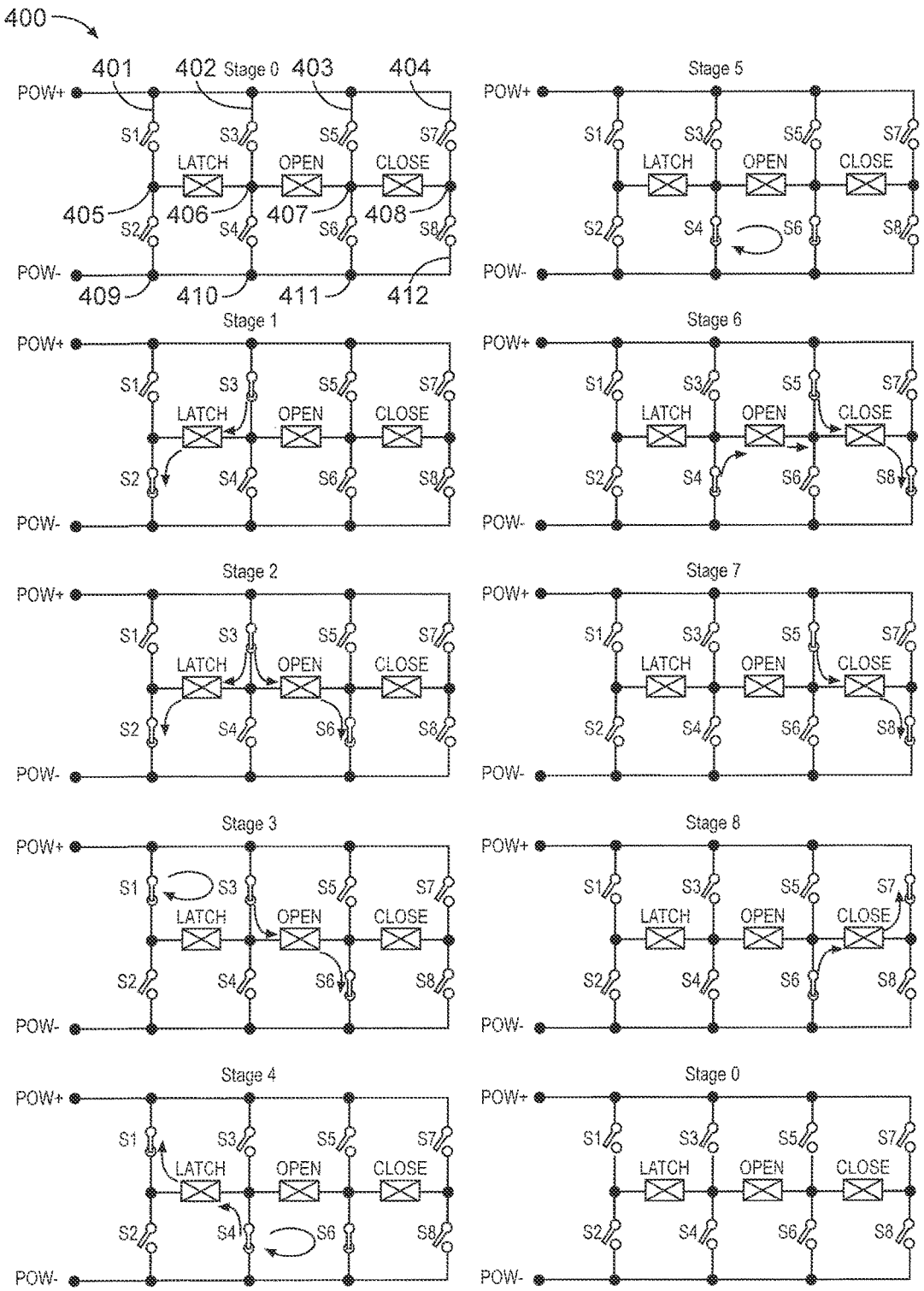
FIG. 4 is a diagram showing an example solenoid drive system, according to aspects of the present disclosure.

FIG. 4 is a diagram showing an example solenoid drive system 400, according to aspects of the present disclosure. In the embodiment shown, the drive system 400 comprises a plurality of switches S1-S8, which may be used to selectively couple the solenoids of a solenoid actuator to the positive and negative terminals of a power supply, POW+ and POW− respectively. The switches S1 -S8 may comprise solid state switches that may be closed by the application of a control current or voltage. Examples include are not limited to metal-oxide-semiconductor field-effect transistors (MOSEFT), junction gate field-effect transistors ("JEFT"), or insulated-gate bipolar transistors (IGBT). Analog or mechanical switches may also be used within the scope of this disclosure.

In certain embodiments, the drive system may comprise a controller (not shown) that selectively outputs control currents or voltages to the switches S1-S8 to cause the switches S1-S8 to open and close in a pre-determined sequence, as will be described below, each time the solenoid actuator is to be triggered. The controller may comprise a processor, such as a microprocessor, microcontroller, digital signal processor (DSP), application specific integrated circuit (ASIC), or any other digital or analog circuitry configured to interpret and/or execute program instructions and/or process data. In some embodiments, the processor may be communicatively coupled to memory, either integrated with the processor or in a separate memory device, and may be configured to interpret and/or execute program instructions and/or data stored in memory. The program instructions may cause the processor to output voltages or currents to the switches S1-S8 according to the pre-determined sequence. The decision to trigger the actuator may be made at the controller that outputs the voltages and current to the switches S1-S8, or by a separate controller communicably coupled to the controller that outputs the voltages and current to the switches S1-S8.

In the embodiment shown, the solenoid actuator to which the drive system 400 is coupled comprises a latchable push-pull solenoid actuator with a "latch" solenoid, an "open" solenoid, and a "close" solenoid. The latch, open, and close solenoids may be connected in series. Each of the latch, open, and close solenoids may be coupled to the power supply through more than one of the switches S1-S8. In the embodiment shown, the drive system 400 comprises four current pathways 401-404 coupled to POW+, with each comprising one of the switches S1-S8 and each being electrically coupled to one terminal of one of the latch, open, and close solenoids. The current pathways 401-404 may comprise wires or segments of wire, for example. In the embodiment shown, current pathway 401 includes switch S1 and is coupled to a terminal 405 of the latch solenoid; current pathway 402 includes switch S3 and is coupled to a terminal 406 common to the latch solenoid and the open solenoid; current pathway 403 includes switch S5 and is coupled to a terminal 407 common to the open solenoid and the close solenoid; and current pathway 404 includes switch S7 and is coupled to a terminal 408 of the close solenoid. The drive system 400 also comprises four current pathways 409-412 coupled to POW−, with each comprising one of the switches S1-S8 and each being electrically coupled to one terminal of one of the latch, open, and close solenoids. In the embodiment shown, current pathway 409 includes switch S2 and is coupled to terminal 405; current pathway 410 includes switch S4 and is coupled to a terminal 406; current pathway 411 includes switch S6 and is coupled to a terminal 407; and current pathway 412 includes switch S8 and is coupled to a terminal 408.

As stated above, a controller of the drive system 400 may selectively open and close the switches S1-S8 according to a pre-determined sequence. An example sequence is illustrated in FIG. 4 as stages 0-8 of the drive system 400. Stage 0 corresponds to a default position in which all switches S1-S8 are open, none of the solenoids are energized, and the solenoid actuator is locked in a close position. Once the controller determines to move the solenoid actuator to an open position, it may enter Stage 1, in which switches S3 and S2 are closed to allow current to flow through and begin energizing the latch solenoid. After a time delay that depends on the current value and the time necessary to energize the latch solenoid based on that current value, the controller may enter Stage 2, in which switch S6 is closed such that both the latch solenoid and the open solenoid are being energized. At Stage 3, switch S2 may be opened and switch S1 may be closed to allow the fully energized latch solenoid to maintain its charge while the open solenoid continues to charge. Notably, when the latch solenoid is fully energized, it may release an armature of the solenoid actuator, allowing it to move axially.

Once the open solenoid is fully charged, the controller may enter Stage 4, in which switch S4 is closed and switch S3 is opened. Closing switch S4 allows the open solenoid to maintain it full charge, which may cause an armature of the actuator to move to and stay in an open position. Additionally, opening switch S3 allows the latch solenoid to discharge its stored energy back to POW+, which may store the energy to be used later. This is in contrast to disconnecting the latch solenoid from the power supply, as is done typically, in which case the stored energy cannot be discharged from the latch solenoid but is rather dissipated as heat. At Stage 5, the switch S1 may be opened because the latch solenoid is fully discharged and no longer needs a current pathway to POW+. Switches S4 and S6 may remain closed, maintaining the full charge of the open solenoid.

Once the armature has moved into the open position, the controller may move to Stage 6, in which the close solenoid begins charging to move the armature back to a close position. In particular, switches S5 and S8 may be closed to generate a current flow through the close solenoid to charge. Stage 6 may also be characterized by the discharge of energy from the open solenoid. Here, switch S6 is opened to force energy from the open solenoid to be discharged through the close solenoid. Accordingly, the energy stored within the open solenoid is used to charge the close solenoid, reusing the energy and reducing the energy that must be drawn from the power supply. This is in contrast to disconnecting the open solenoid from the power supply, as is typically done, causing the open solenoid to dissipate stored energy as heat and the close solenoid to be fully energized using energy from the power supply.

Once the open solenoid is fully discharged at stage 7, switch S4 may be opened and switches S5 and S8 may remain closed to allow the close solenoid to be fully energized. Once the close solenoid is fully energized and the armature has moved back to the close position, the controller may enter stage 8 in which switches S5 and S8 are opened and switches S6 and S7 are closed. This allows the close solenoid to discharge the stored energy back to the power supply, preventing the energy from being dissipated in the close solenoid as heat. Once the close solenoid has been fully discharged, the controller may again enter stage 0 until the controller again determines to trigger the actuator.

Figure 5:
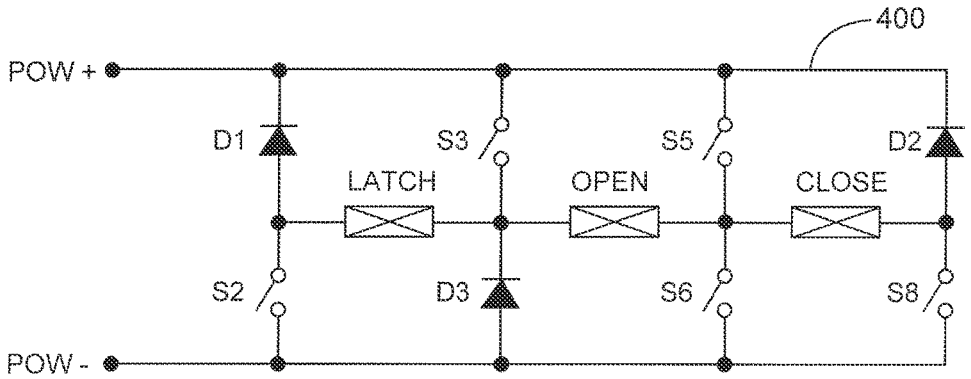
FIG. 5 is a diagram showing another example solenoid drive system, according to aspects of the present disclosure.

In certain embodiments, different configurations and placements of switches may be used to allow the solenoids to discharge stored energy to the power supply or other solenoids. Additionally, some of the switches may be removed. FIG. 5 is a diagram showing the drive system 400 in which switches S1, S4 and S7 have been removed an replaced with diodes D1, D3, and D2, respectively. These diodes may comprise freewheeling diodes that are oriented to allow the current flows indicated in stages 3, 6 and 8 of FIG. 4 that function to discharge the energy stored in the latch, open, and close solenoids. In certain instances, the diodes D1, D3, and D2 may simplify the control steps by reducing the number of switches that must be controlled by the drive system 400.

Figure 6:
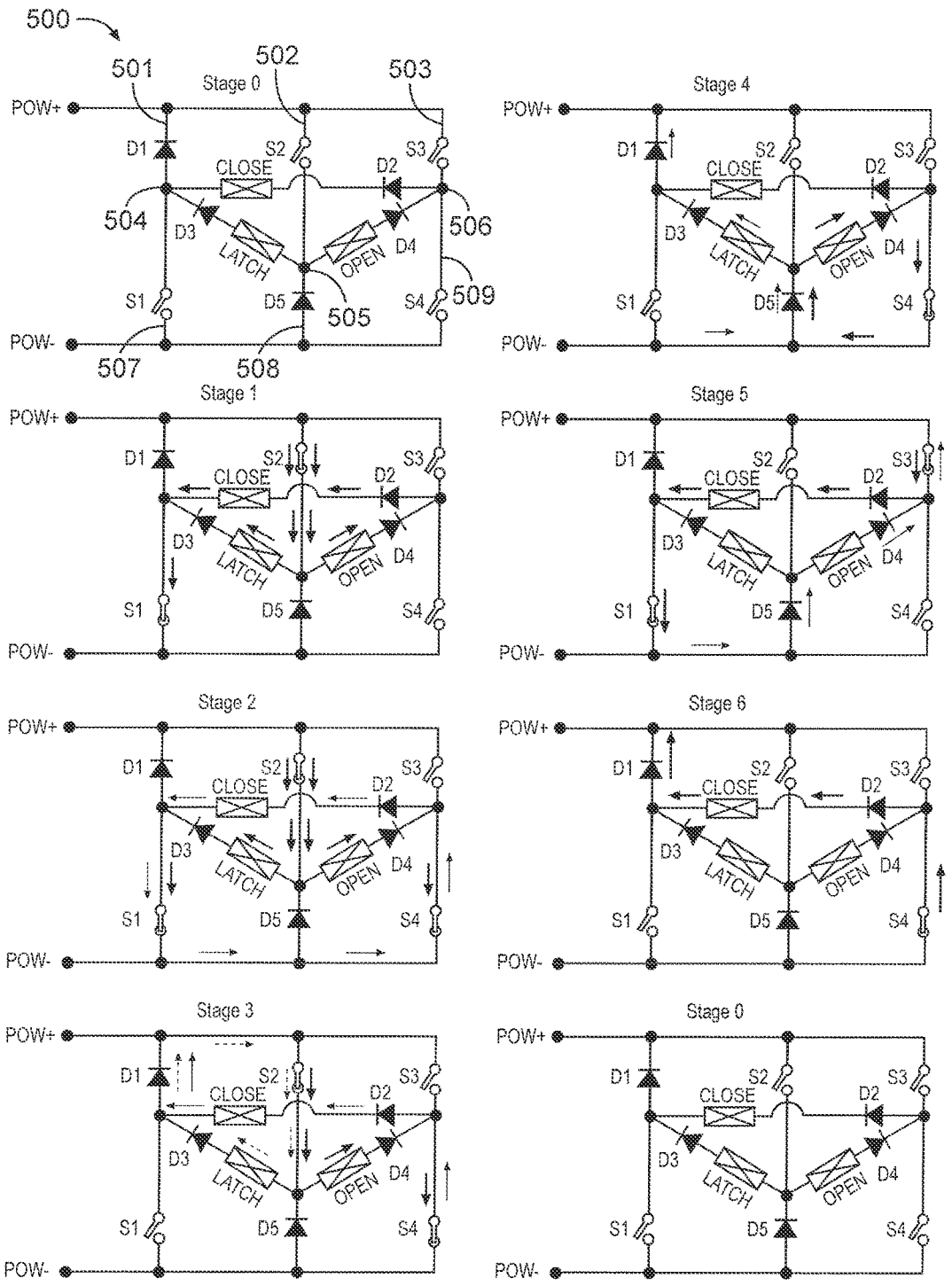
FIG. 6 is a diagram showing another example solenoid drive system, according to aspects of the present disclosure.

FIG. 6 is a diagram showing another example solenoid drive system 500, according to aspects of the present disclosure. In the embodiment shown, the drive system 500 comprises a plurality of switches S1-S4 and a plurality of diodes D1-D5 that are configured to control a latchable push-pull solenoid actuator with a "latch" solenoid, an "open" solenoid, and a "close" solenoid. Here, the latch, open, and close solenoids are arranged in a Δ-mode system, and the switches S1-S4 and diodes D1-D5 may selectively couple the solenoids of a solenoid actuator to the positive and negative terminals of a power supply, POW+ and POW− respectively, and allow the solenoids to discharge stored energy to the power supply or other solenoids. In particular, each of the latch, open, and close solenoids may be coupled to the power supply through a plurality of switches. The drive system 500 may further comprise a controller that functions similar to the one described above with respect to FIG. 4.

In the embodiment shown, the drive system 500 comprises three current pathways 501-503 coupled to POW+, with each comprising one of the switches S1-S4 and diodes D1-D5 and each being electrically coupled to one terminal of one of the latch, open, and close solenoids. In the embodiment shown, current pathway 501 includes diode D1 and is coupled to a terminal 504 common to the close solenoid, and to the latch solenoid through an intermediate diode D3; current pathway 502 includes switch S2 and is coupled to a terminal 505 common to the latch solenoid and the open solenoid; and current pathway 503 includes switch S3 and is coupled to a terminal 506 common to the close solenoid through an intermediate diode D2, and to the open solenoid through an intermediate diode D4. The drive system 500 also comprises three current pathways 507-509 coupled to POW−, with each comprising one of the switches S1-S4 and diodes D1-D5 and each being electrically coupled to one terminal of one of the latch, open, and close solenoids. In the embodiment shown, current pathway 507 includes switch S1 and is coupled to terminal 504; current pathway 508 includes diode D5 and is coupled to terminal 505; and current pathway 509 includes switch S4 and is coupled to terminal 506.

A controller (not shown) of the drive system 500 may open and close the switches S1-S4 according to a predetermined sequence to selectively couple the latch, open, and close solenoids to the power supply and allow the latch, open, and close solenoids to discharge stored energy to the power supply or other solenoids. An example sequence is illustrated in FIG. 6 as stages 0-6. Stage 0 corresponds to a default position in which all switches S1-S4 are open, none of the solenoids are energized, and the solenoid actuator is locked in a close position. Once the controller determines to move the solenoid actuator to an open position, it may enter Stage 1, in which switches S1 and S2 are closed to allow current to flow through and begin energizing the latch solenoid. In addition to current flowing through the latch solenoid, current may also flow through the open solenoid, diodes D4 and D4, and close solenoid, energizing the open and close solenoid in series. At stage 2, switch S4 may be closed, such that the latch solenoid and open solenoid continue charge, but current flowing through the open solenoid travels through switch S4 instead of the close solenoid. The close solenoid may be freewheeling in stage 2, generating a secondary current flow and discharging energy though the diode D2. Once the latch solenoid is fully charged, the controller may move to stage 3, in which the switch S1 is opened and switches S2 and S4 remain closed, allowing the latch solenoid to maintain full energy while the open solenoid continues to charge. When full energized, the latch solenoid may allow the armature of the solenoid actuator to move from the close position to the open position.

At stage 4, the open solenoid may be fully energized and move the armature to the open position. The controller may open switch S1, allowing the open solenoid to maintain its energy while allowing the latch solenoid to discharge its stored energy to POW+ through the diodes D3 and D5. At stage 5, the switches S1 and S3 may be closed, allowing the open solenoid to discharge its stored energy to POW+ and the closed solenoid, as well as charging the close solenoid. At stage 6, switch S4 may be closed to allow the close solenoid to discharged its stored energy to POW+. When the close solenoid is fully discharged, the controller may again enter stage 0 until the controller next determines it needs to trigger the actuator.

According to aspects of the present disclosure, an example method for driving a solenoid actuator includes providing at least one solenoid of the solenoid actuator coupled to a power supply through a plurality of switches. The at least one solenoid of the solenoid actuator may be energized by closing at least one switch of the plurality of switches. Energy from the at least one solenoid may be discharged to the power supply or another solenoid of the solenoid actuator by at least one of opening the at least one switch of the plurality of switches and closing at least one other switch of the plurality of switches.

In certain embodiments, providing at least one solenoid of the solenoid coupled to the power supply through the plurality of switches comprises providing a latch solenoid, an open solenoid, and a close solenoid coupled to the power supply through the plurality of switches. In certain embodiments, providing the latch solenoid, the open solenoid, and the close solenoid coupled to the power supply through the plurality of switches comprises providing the latch solenoid, the open solenoid, and the close solenoid in series with each terminal of the each of the latch solenoid, the open solenoid, and the close solenoid coupled to the power supply through at least one of a switch of the plurality of switches or a diode. In certain embodiments, energizing at least one solenoid of the solenoid actuator by closing at least one switch of the plurality of switches comprises energizing the latch solenoid by closing a switch between a first lead of the power supply and a common terminal between the latch solenoid and the open solenoid and a switch between a second lead of the power supply and another terminal of the latch solenoid; and discharging energy from the at least one solenoid to the power supply or another solenoid of the solenoid actuator by closing at least one other switch of the plurality of switches comprises discharging energy from the latch solenoid by closing a switch between the first lead of the power supply and the another terminal of the latch solenoid and a switch between the second lead of the power supply and the common terminal between the latch solenoid and the open solenoid.

In certain embodiments, energizing at least one solenoid of the solenoid actuator by closing at least one switch of the plurality of switches comprises energizing the open solenoid by closing a switch between a first lead of the power supply and a common terminal between the latch solenoid and the open solenoid and a switch between a second lead of the power supply and a common terminal between the open solenoid and the close solenoid; and discharging energy from the at least one solenoid to the power supply or another solenoid of the solenoid actuator by closing at least one other switch of the plurality of switches comprises discharging energy from the open solenoid by closing a switch between the first lead of the power supply and a common terminal between the latch solenoid and the open solenoid and a switch between the second lead of the power supply and another terminal of the close solenoid. In certain embodiments, energizing at least one solenoid of the solenoid actuator by closing at least one switch of the plurality of switches comprises energizing the close solenoid by closing a switch between a first lead of the power supply and a common terminal between the open solenoid and the close solenoid and a switch between a second lead of the power supply and another terminal of the close solenoid; and discharging energy from the at least one solenoid to the power supply or another solenoid of the solenoid actuator by closing at least one other switch of the plurality of switches comprises discharging energy from the close solenoid by closing a switch between the first lead of the power supply and the another terminal of the close solenoid and a switch between the second lead of the power supply and the common terminal between the open solenoid and the close solenoid.

In certain embodiments, providing the latch solenoid, the open solenoid, and the close solenoid coupled to the power supply through the plurality of switches comprises providing the latch solenoid, the open solenoid, and the close solenoid in a delta configuration with each terminal of the each of the latch solenoid, the open solenoid, and the close solenoid coupled to the power supply through at least one of a switch of the plurality of switches or a diode. In certain embodiments, energizing at least one solenoid of the solenoid actuator by closing at least one switch of the plurality of switches comprises energizing the latch solenoid by closing a first switch between a first lead of the power supply and a common terminal between the latch solenoid and the open solenoid and a second switch between a second lead of the power supply and another terminal of the latch solenoid; and discharging energy from the at least one solenoid to the power supply or another solenoid of the solenoid actuator comprises discharging energy from the latch solenoid by opening the first and second switches. In certain embodiments, energizing at least one solenoid of the solenoid actuator by closing at least one switch of the plurality of switches comprises energizing the open solenoid by closing a switch between a first lead of the power supply and a common terminal between the latch solenoid and the open solenoid and a switch between a second lead of the power supply and a common terminal between the open solenoid and the close solenoid; and discharging energy from the at least one solenoid to the power supply or another solenoid of the solenoid actuator comprises discharging energy from the open solenoid by closing a switch between the first lead of the power supply and the common terminal between the open solenoid and the close solenoid. In certain embodiments, energizing at least one solenoid of the solenoid actuator by closing at least one switch of the plurality of switches comprises energizing the close solenoid by closing a switch between a first lead of the power supply and a common terminal between the open solenoid and the close solenoid and a switch between a second lead of the power supply and a common terminal between the close solenoid and the latch solenoid; and discharging energy from the at least one solenoid to the power supply or another solenoid of the solenoid actuator comprises discharging energy from the close solenoid by closing a switch between the second lead of the power supply and the common terminal between the open solenoid and the close solenoid.

According to aspects of the present disclosure, an example system comprises a solenoid actuator with at least one solenoid; a power supply coupled to the at least one solenoid through a plurality of switches; and a controller electrically coupled to the plurality of switches, the controller comprising a processor and a memory device coupled to the process. The memory device may contain a set of instructions that, when executed by the processor cause the processor to energize at least one solenoid of the solenoid actuator by closing at least one switch of the plurality of switches; and discharge energy from the at least one solenoid to the power supply or another solenoid of the solenoid actuator by at least one of opening the at least one switch of the plurality of switches and closing at least one other switch of the plurality of switches.

In certain embodiments, the at least one solenoid of the solenoid actuator comprises a latch solenoid, an open solenoid, and a close solenoid. In certain embodiments, the latch solenoid, the open solenoid, and the close solenoid are electrically in series with each terminal of the each of the latch solenoid, the open solenoid, and the close solenoid coupled to the power supply through at least one of a switch of the plurality of switches or a diode. In certain embodiments, the set of instructions that cause the processor to energize at least one solenoid of the solenoid actuator by closing at least one switch of the plurality of switches further causes the processor to energize the latch solenoid by closing a switch between a first lead of the power supply and a common terminal between the latch solenoid and the open solenoid and a switch between a second lead of the power supply and another terminal of the latch solenoid; and the set of instructions that cause the processor to discharge energy from the at least one solenoid to the power supply or another solenoid of the solenoid actuator by closing at least one other switch of the plurality of switches further causes the processor to discharge energy from the latch solenoid by closing a switch between the first lead of the power supply and the another terminal of the latch solenoid and a switch between the second lead of the power supply and the common terminal between the latch solenoid and the open solenoid. In certain embodiments, the set of instructions that cause the processor to energize at least one solenoid of the solenoid actuator by closing at least one switch of the plurality of switches further causes the processor to energize the open solenoid by closing a switch between a first lead of the power supply and a common terminal between the latch solenoid and the open solenoid and a switch between a second lead of the power supply and a common terminal between the open solenoid and the close solenoid; and the set of instructions that cause the processor to discharge energy from the at least one solenoid to the power supply or another solenoid of the solenoid actuator by closing at least one other switch of the plurality of switches further causes the processor to discharge energy from the open solenoid by closing a switch between the first lead of the power supply and a common terminal between the latch solenoid and the open solenoid and a switch between the second lead of the power supply and another terminal of the close solenoid. In certain embodiments, the set of instructions that cause the processor to energize at least one solenoid of the solenoid actuator by closing at least one switch of the plurality of switches further causes the processor to energize the close solenoid by closing a switch between a first lead of the power supply and a common terminal between the open solenoid and the close solenoid and a switch between a second lead of the power supply and another terminal of the close solenoid; and the set of instructions that cause the processor to discharge energy from the at least one solenoid to the power supply or another solenoid of the solenoid actuator by closing at least one other switch of the plurality of switches further causes the processor to discharge energy from the close solenoid by closing a switch between the first lead of the power supply and the another terminal of the close solenoid and a switch between the second lead of the power supply and the common terminal between the open solenoid and the close solenoid.

In certain embodiments, the latch solenoid, the open solenoid, and the close solenoid are arranged in a delta configuration with each terminal of the each of the latch solenoid, the open solenoid, and the close solenoid coupled to the power supply through at least one of a switch of the plurality of switches or a diode. In certain embodiments, the set of instructions that cause the processor to energize at least one solenoid of the solenoid actuator by closing at least one switch of the plurality of switches further causes the processor to energize the latch solenoid by closing a first switch between a first lead of the power supply and a common terminal between the latch solenoid and the open solenoid and a second switch between a second lead of the power supply and another terminal of the latch solenoid; and the set of instructions that cause the processor to discharge energy from the at least one solenoid to the power supply or another solenoid of the solenoid actuator further causes the processor to discharge energy from the latch solenoid by opening the first and second switches. In certain embodiments, the set of instructions that cause the processor to energize at least one solenoid of the solenoid actuator by closing at least one switch of the plurality of switches further causes the processor to energize the open solenoid by closing a switch between a first lead of the power supply and a common terminal between the latch solenoid and the open solenoid and a switch between a second lead of the power supply and a common terminal between the open solenoid and the close solenoid; and the set of instructions that cause the processor to discharge energy from the at least one solenoid to the power supply or another solenoid of the solenoid actuator further causes the processor to discharge energy from the open solenoid by closing a switch between the first lead of the power supply and the common terminal between the open solenoid and the close solenoid. In certain embodiments, the set of instructions that cause the processor to energize at least one solenoid of the solenoid actuator by closing at least one switch of the plurality of switches further causes the processor to energize the close solenoid by closing a switch between a first lead of the power supply and a common terminal between the open solenoid and the close solenoid and a switch between a second lead of the power supply and a common terminal between the close solenoid and the latch solenoid; and the set of instructions that cause the processor to discharge energy from the at least one solenoid to the power supply or another solenoid of the solenoid actuator further causes the processor to discharge energy from the close solenoid by closing a switch between the second lead of the power supply and the common terminal between the open solenoid and the close solenoid.

In any embodiment described in the preceding three paragraphs, the switches may comprise solid state switches. In any embodiment described in the preceding three paragraphs, the system may further comprise a housing of a downhole telemetry system, wherein the solenoid actuator is coupled to the housing.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A method for driving a solenoid actuator, comprising:

providing a plurality of solenoids of the solenoid actuator, wherein the plurality of solenoids comprise a latch solenoid, an open solenoid and a close solenoid coupled to a power supply through a plurality of switches;

energizing at least one solenoid of the plurality of solenoids by closing at least one switch of the plurality of switches; and discharging energy from the at least one solenoid to the power supply or another solenoid of the plurality of solenoids by at least one of opening the at least one switch of the plurality of switches and closing at least one other switch of the plurality of switches.

2. The method of claim 1, wherein providing the latch solenoid, the open solenoid, and the close solenoid coupled to the power supply through the plurality of switches comprises providing the latch solenoid, the open solenoid, and the close solenoid in series with each terminal of the each of the latch solenoid, the open solenoid, and the close solenoid coupled to the power supply through at least one of a switch of the plurality of switches or a diode.

3. The method of claim 2, wherein energizing the at least one solenoid of the plurality of solenoids by closing at least one switch of the plurality of switches comprises energizing the latch solenoid by closing a switch between a first lead of the power supply and a common terminal between the latch solenoid and the open solenoid and a switch between a second lead of the power supply and another terminal of the latch solenoid; and discharging energy from the at least one solenoid to the power supply or another solenoid of the solenoid actuator by closing at least one other switch of the plurality of switches comprises discharging energy from the latch solenoid by closing a switch between the first lead of the power supply and the another terminal of the latch solenoid and a switch between the second lead of the power supply and the common terminal between the latch solenoid and the open solenoid.

4. The method of claim 2, wherein energizing the at least one solenoid of the plurality of solenoids by closing at least one switch of the plurality of switches comprises energizing the open solenoid by closing a switch between a first lead of the power supply and a common terminal between the latch solenoid and the open solenoid and a switch between a second lead of the power supply and a common terminal between the open solenoid and the close solenoid; and discharging energy from the at least one solenoid to the power supply or another solenoid of the plurality of solenoids by closing at least one other switch of the plurality of switches comprises discharging energy from the open solenoid by closing a switch between the first lead of the power supply and a common terminal between the latch solenoid and the open solenoid and a switch between the second lead of the power supply and another terminal of the close solenoid.

5. The method of claim 2, wherein energizing the at least one solenoid of the plurality of solenoids by closing at least one switch of the plurality of switches comprises energizing the close solenoid by closing a switch between a first lead of the power supply and a common terminal between the open solenoid and the close solenoid and a switch between a second lead of the power supply and another terminal of the close solenoid; and discharging energy from the at least one solenoid to the power supply or another solenoid of the plurality of solenoids by closing at least one other switch of the plurality of switches comprises discharging energy from the close solenoid by closing a switch between the first lead of the power supply and the another terminal of the close solenoid and a switch between the second lead of the power supply and the common terminal between the open solenoid and the close solenoid.

6. The method of claim 1, wherein providing the latch solenoid, the open solenoid, and the close solenoid coupled to the power supply through the plurality of switches comprises providing the latch solenoid, the open solenoid, and the close solenoid in a delta configuration with each terminal of the each of the latch solenoid, the open solenoid, and the close solenoid coupled to the power supply through at least one of a switch of the plurality of switches or a diode.

7. The method of claim 6, wherein energizing the at least one solenoid of the plurality of solenoids by closing at least one switch of the plurality of switches comprises energizing the latch solenoid by closing a first switch between a first lead of the power supply and a common terminal between the latch solenoid and the open solenoid and a second switch between a second lead of the power supply and another terminal of the latch solenoid; and discharging energy from the at least one solenoid to the power supply or another solenoid of the plurality of solenoids comprises discharging energy from the latch solenoid by opening the first and second switches.

8. The method of claim 6, wherein energizing the at least one solenoid of the plurality of solenoids by closing at least one switch of the plurality of switches comprises energizing the open solenoid by closing a switch between a first lead of the power supply and a common terminal between the latch solenoid and the open solenoid and a switch between a second lead of the power supply and a common terminal between the open solenoid and the close solenoid; and discharging energy from the at least one solenoid to the power supply or another solenoid of the plurality of solenoids comprises discharging energy from the open solenoid by closing a switch between the first lead of the power supply and the common terminal between the open solenoid and the close solenoid.

9. The method of claim 6, wherein energizing at least one solenoid of the plurality of solenoids by closing at least one switch of the plurality of switches comprises energizing the close solenoid by closing a switch between a first lead of the power supply and a common terminal between the open solenoid and the close solenoid and a switch between a second lead of the power supply and a common terminal between the close solenoid and the latch solenoid; and discharging energy from the at least one solenoid to the power supply or another solenoid of the plurality of solenoids comprises discharging energy from the close solenoid by closing a switch between the second lead of the power supply and the common terminal between the open solenoid and the close solenoid.

10. A system, comprising:

a solenoid actuator with a plurality of solenoids, wherein the plurality of solenoids comprise a latch solenoid, an open solenoid and a close solenoid;

a power supply coupled to at least one solenoid of the plurality of solenoids through a plurality of switches;

a controller electrically coupled to the plurality of switches, the controller comprising a processor and a memory device coupled to the process, the memory device containing a set of instructions that, when executed by the processor cause the processor to energize the at least one solenoid by closing at least one switch of the plurality of switches; and discharge energy from the at least one solenoid to the power supply or another solenoid of the plurality of solenoids by at least one of opening the at least one switch of the plurality of switches and closing at least one other switch of the plurality of switches.

11. The system of claim 10, wherein the latch solenoid, the open solenoid, and the close solenoid are electrically in series with each terminal of the each of the latch solenoid, the open solenoid, and the close solenoid coupled to the power supply through at least one of a switch of the plurality of switches or a diode.

12. The system of claim 11, wherein the set of instructions that cause the processor to energize the at least one solenoid of the plurality of solenoids by closing at least one switch of the plurality of switches further causes the processor to energize the latch solenoid by closing a switch between a first lead of the power supply and a common terminal between the latch solenoid and the open solenoid and a switch between a second lead of the power supply and another terminal of the latch solenoid; and the set of instructions that cause the processor to discharge energy from the at least one solenoid to the power supply or another solenoid of the plurality of solenoids by closing at least one other switch of the plurality of switches further causes the processor to discharge energy from the latch solenoid by closing a switch between the first lead of the power supply and the another terminal of the latch solenoid and a switch between the second lead of the power supply and the common terminal between the latch solenoid and the open solenoid.

13. The system of claim 11, wherein the set of instructions that cause the processor to energize the at least one solenoid of the plurality of solenoids by closing at least one switch of the plurality of switches further causes the processor to energize the open solenoid by closing a switch between a first lead of the power supply and a common terminal between the latch solenoid and the open solenoid and a switch between a second lead of the power supply and a common terminal between the open solenoid and the close solenoid; and the set of instructions that cause the processor to discharge energy from the at least one solenoid to the power supply or another solenoid of the plurality of solenoids by closing at least one other switch of the plurality of switches further causes the processor to discharge energy from the open solenoid by closing a switch between the first lead of the power supply and a common terminal between the latch solenoid and the open solenoid and a switch between the second lead of the power supply and another terminal of the close solenoid.

14. The system of claim 11, wherein the set of instructions that cause the processor to energize the at least one solenoid of the plurality of solenoids by closing at least one switch of the plurality of switches further causes the processor to energize the close solenoid by closing a switch between a first lead of the power supply and a common terminal between the open solenoid and the close solenoid and a switch between a second lead of the power supply and another terminal of the close solenoid; and the set of instructions that cause the processor to discharge energy from the at least one solenoid to the power supply or another solenoid of the plurality of solenoids by closing at least one other switch of the plurality of switches further causes the processor to discharge energy from the close solenoid by closing a switch between the first lead of the power supply and the another terminal of the close solenoid and a switch between the second lead of the power supply and the common terminal between the open solenoid and the close solenoid.

15. The system of claim 10, wherein the latch solenoid, the open solenoid, and the close solenoid are arranged in a delta configuration with each terminal of the each of the latch solenoid, the open solenoid, and the close solenoid coupled to the power supply through at least one of a switch of the plurality of switches or a diode.

16. The system of claim 15, wherein the set of instructions that cause the processor to energize the at least one solenoid of the plurality of solenoids by closing at least one switch of the plurality of switches further causes the processor to energize the latch solenoid by closing a first switch between a first lead of the power supply and a common terminal between the latch solenoid and the open solenoid and a second switch between a second lead of the power supply and another terminal of the latch solenoid; and the set of instructions that cause the processor to discharge energy from the at least one solenoid to the power supply or another solenoid of the plurality of solenoids further causes the processor to discharge energy from the latch solenoid by opening the first and second switches.

17. The system of claim 15, wherein the set of instructions that cause the processor to energize the at least one solenoid of the plurality of solenoids by closing at least one switch of the plurality of switches further causes the processor to energize the open solenoid by closing a switch between a first lead of the power supply and a common terminal between the latch solenoid and the open solenoid and a switch between a second lead of the power supply and a common terminal between the open solenoid and the close solenoid; and the set of instructions that cause the processor to discharge energy from the at least one solenoid to the power supply or another solenoid of the plurality of solenoids further causes the processor to discharge energy from the open solenoid by closing a switch between the first lead of the power supply and the common terminal between the open solenoid and the close solenoid.

18. The system of claim 15, wherein the set of instructions that cause the processor to energize the at least one solenoid of the plurality of solenoids by closing at least one switch of the plurality of switches further causes the processor to energize the close solenoid by closing a switch between a first lead of the power supply and a common terminal between the open solenoid and the close solenoid and a switch between a second lead of the power supply and a common terminal between the close solenoid and the latch solenoid; and the set of instructions that cause the processor to discharge energy from the at least one solenoid to the power supply or another solenoid of the plurality of solenoids further causes the processor to discharge energy from the close solenoid by closing a switch between the second lead of the power supply and the common terminal between the open solenoid and the close solenoid.

19. The system of claim 10, wherein the switches comprise solid state switches.

20. The system of claim 10, further comprising a housing of a downhole telemetry system, wherein the solenoid actuator is coupled to the housing.

* * * * *